US005874727A

United States Patent [19]

Harraeus et al.

[11] Patent Number: 5,874,727

[45] Date of Patent: Feb. 23, 1999

[54] METHOD AND APPARATUS FOR COMBATTING HELICOPTERS OPERATING WITH CONCEALMENT

[75] Inventors: Egbert Harraeus, Neubiberg; Bernt Obkircher, Horgenzell, both of Germany

[73] Assignee: Daimler-Benz Aerospace AG, Germany

[21] Appl. No.: 603,320

[22] Filed: Feb. 10, 1996

[30] Foreign Application Priority Data

Feb. 20, 1995 [DE] Germany ..... 195 05 791.0

[51] Int. Cl.[6] ..... F41G 7/22; F42B 25/24

[52] U.S. Cl. ..... 250/203.1; 244/3.15; 102/384

[58] Field of Search ..... 250/203.1, 206; 102/384; 244/3.15, 3.16, 3.21, 3.22

[56] References Cited

U.S. PATENT DOCUMENTS 4,241,889 12/1980 Schwellinger et al. ..... 244/3.15

4,383,663 5/1983 Nichols ..... 244/3.16

4,568,040 2/1986 Metz ..... 102/384

*Primary Examiner*—Stephone B. Allen

*Attorney, Agent, or Firm*—Evenson, McKeown, Edwards & Lenahan, P.L.L.C.

[57] ABSTRACT

The invention provides a method for continuous acquisition, identification, and attack of helicopters operating with concealment, using a missile with an integrated target search head computer control. The visual field of the search head is adapted optimally in both the search phase and in the target tracking phase. During the search phase, the missile travels a flight path roughly parallel to the surface of the ground, and the axis of the line of sight is directed diagonally downward at a suitable angle. During a target tracking, the line of sight runs collinearly with the missile axis. The natural radiation of the helicopter modulated by the rotor blade movement is used for target recognition.

12 Claims, 3 Drawing Sheets

METHOD AND APPARATUS FOR COMBATTING HELICOPTERS OPERATING WITH CONCEALMENT

BACKGROUND AND SUMMARY OF THE INVENTION

The present invention relates to a method and apparatus for combatting enemy helicopters which operate from a concealed position, emerging briefly and then using cover once again. The system according to the invention can be implemented even following loss of visual contact, using an electro-optical search head specially developed for helicopter-type recognition.

Various devices of this type are known. German Patent Document DE 37 33 681 C1, for example, discloses a device which uses a so-called infrared search head for helicopter detection. The search head consists essentially of an optical receiving arrangement in whose focal plane infrared-sensitive detector elements are arranged in a rectangular matrix. Each detector element can be read individually and the resultant signal investigated as to amplitude and frequency pattern.

The observation axis of the search head is directed vertically downward, since it is assumed that enemy helicopters move near the ground using the shelter of the terrain. The search head is designed so that it can reliably detect helicopters by reason of its visual field design and its height above the ground, based on their natural radiation, characteristically modulated by rotor blade movement, in a defined search area.

The design of the search head for the vertical observation direction limits considerably the operational performance of a defensive missile equipped with such a sensor, especially when the latter must be "shoulder fireable." Criteria for shoulder fireability are low weight (typically 12 kg), simple handling, high reliability, and a favorable cost-benefit ratio.

This sensor, which is directed vertically downward, can be used as follows in conjunction with a missile. When the observing shooter detects an enemy helicopter, he estimates the distance to the target and enters it into the missile launcher. Since the visual field of the sensor is limited, the success of the combat measure is critically dependent on the reliability of this estimate. In addition, assurance must be provided that the search areas established by the estimated values overlap. The missile is launched and, depending on the range and the predetermined visual field of the sensor, follows a preset flight path to a typical altitude of 800–1200 meters, where it is braked by a drogue chute. After the braking process is complete, the lengthwise axis of the missile is oriented vertically so that the target search head begins looking downward, and the search phase begins. The speed of fall must be adjusted by the chute to the performance of the signal evaluation method. When the target is acquired, the chute is released. The remaining part of the missile, containing the warhead, must now be accelerated from a slow falling speed so that the target itself can be reliably attacked at maximum flight speed.

The disadvantages of the above known device regarding efficiency of a weapon system are apparent:

- False range estimates result in a miss, which can only be avoided by providing an additional laser rangefinder;
- The search phase takes place at low missile speed. During this time, the target can travel an additional distance, and overcoming this problem imposes increased demands on the target tracking speed of the missile;

- The unfavorable energy balance of the fuel consumption, which is increased by additional braking and accelerating maneuvers, results in an increase in weight and an unfavorable cost-benefit ratio;
- The chute increases both the complexity of the missile, (and hence its failure rate) and its manufacturing costs; and
- Without additional measures for electronic or mechanical image stabilization in the search head, the oscillating movements of the missile while suspended from the chute during the search phase cannot be compensated, so that the frequency of the helicopter radiation cannot really be detected at all, as stated in DE 37 33 681 C1.

An object of the present invention is to provide a simple and effective method and apparatus for reliably recognizing and attacking helicopters operating with concealment; in other words, without a visual link between the shooter and the target, without range measurement, and with a low missile weight. It is also important that the search for the target can take place when the flight profile is in a plane parallel to, or at a small angle of inclination to, the ground.

This and other objects and advantages are achieved by the missile guidance and tracking system according to the present invention in which the target search head of the missile is equipped with an optical lens system with two wedge shaped elements, at least one of which can be rotated relative to the other in order to adjust a line of sight axis of an optical image field thereof. After the missile is launched and rises to a predetermined altitude, it is then guided along an essentially horizontal flight path during a search phase in which the first and second wedge shaped optical elements are adjusted relative to each other in such a manner that the axis of the image field is directed downward toward the terrain passing beneath the missile. When the target helicopter is detected in the image field of the target search head, the missile enters a tracking phase in which it is guided downward to impact the target. For this purpose, the wedge shaped elements are rotated relative to one another to a position in which the image field of the target search head is directed along a longitudinal axis of the missile, and is aligned with the flight path. Information from the target search head is then used to guide the missile to target impact.

Other objects, advantages and novel features of the present invention will become apparent from the following detailed description of the invention when considered in conjunction with the accompanying drawings.

DETAILED DESCRIPTION OF THE DRAWINGS

Figure 1:
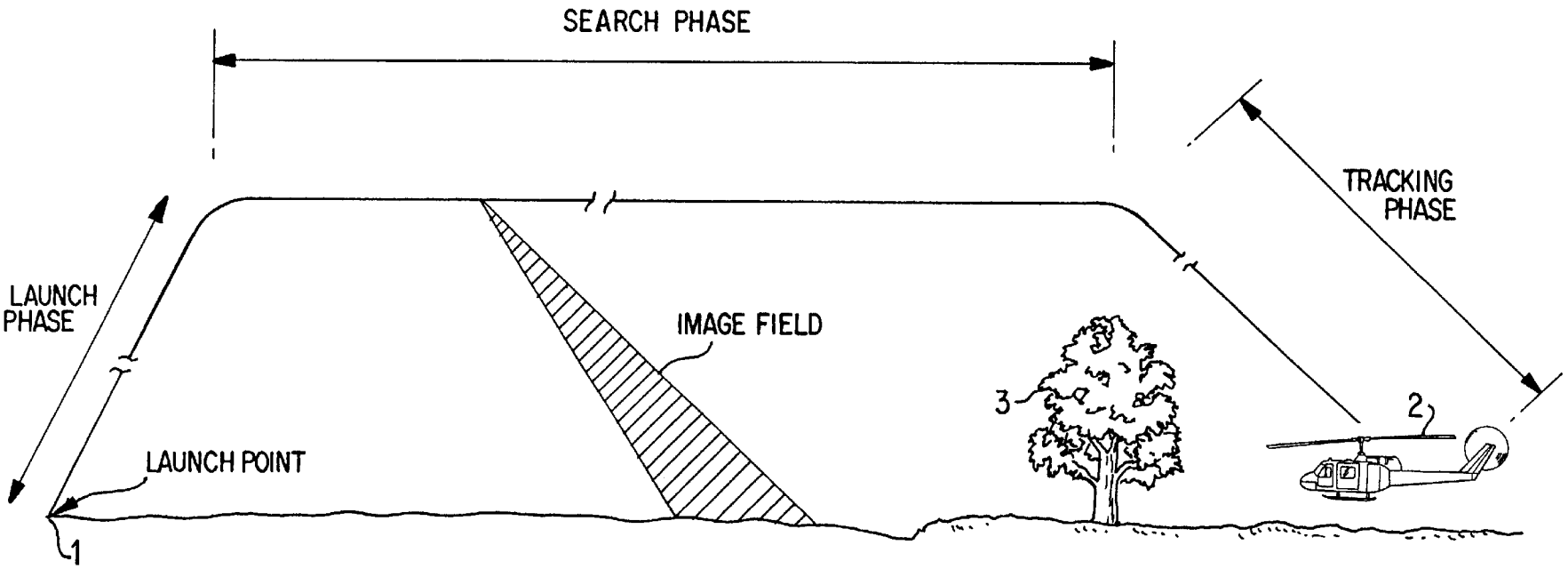
FIG. 1 is a schematic diagram which illustrates the operational task according to the invention.

FIG. 1 shows the operational task schematically. A shooter positioned at the launching site 1 determines on the basis of previous observations that an enemy target 2 has been located, concealed behind a trees. Hence there is no direct visual link between him and the target. The shoulder launcher (not shown) is aimed approximately at the target, and the missile is launched at a typical elevation angle of 70°. At a typical altitude of 800 m, the missile pivots into a flight path that is approximately parallel to the terrain. At this point the search phase begins.

Figure 2:
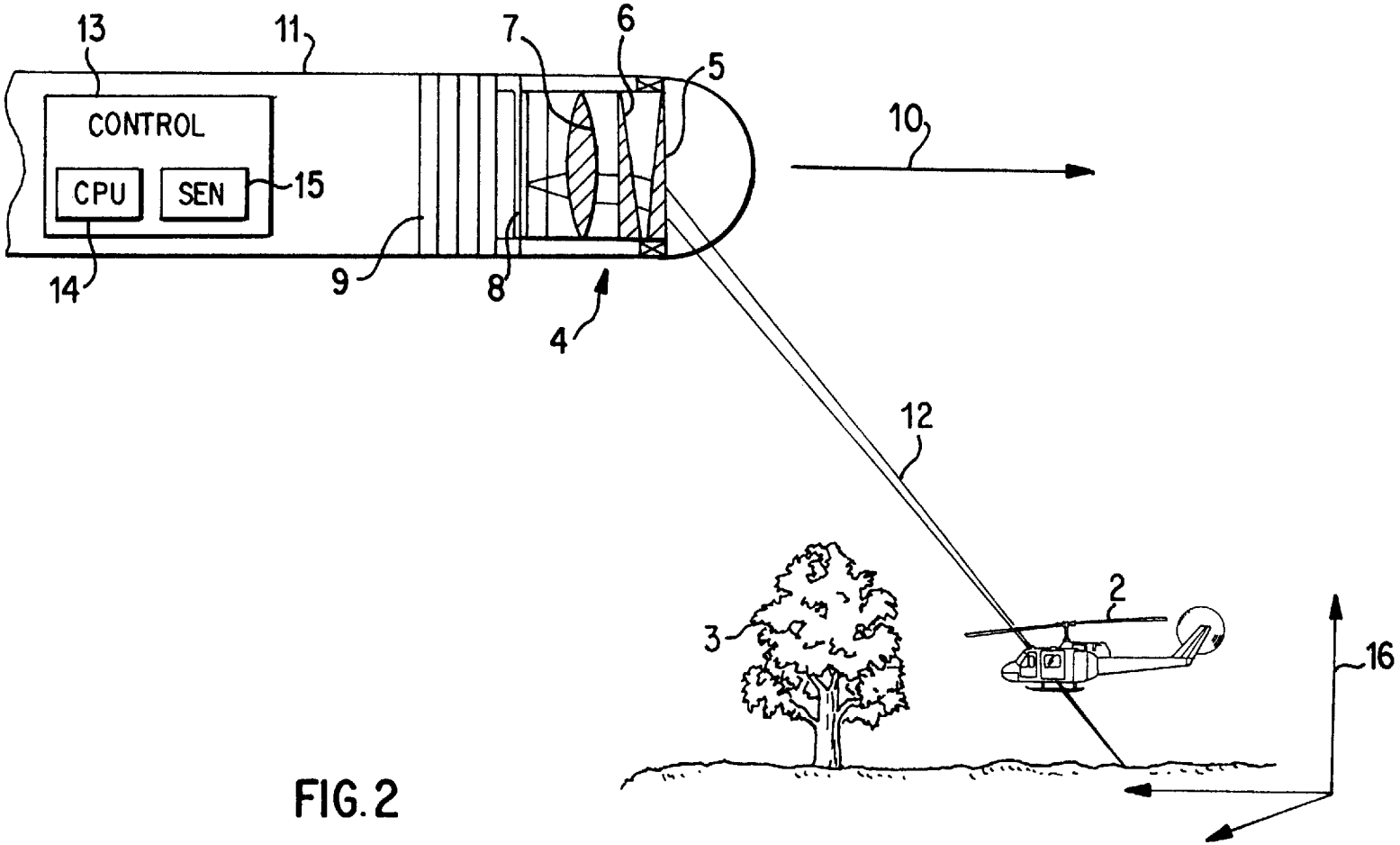
FIG. 2 is a schematic diagram of the search phase according to the invention.

As shown in FIG. 2, the missile guidance and tracking apparatus according to the invention comprises an optical receiving lens system 4 which has a rotatable wedge shaped element 5, a stationary wedge shaped element 6 and an objective 7. Light from the lens system 4 is focused on a detector matrix 8 situated in the lens system's focal plane. Output signals from the detector matrix 8 are provided to a signal processing unit 9 where they are analyzed to identify the target, track its movement and guide the missile 11 to achieve a hit.

The relative position of the rotatable and stationary wedge element 5, 6 determines the observation axis 12 of the lens system 4. With both wedge elements oriented in the same position as shown in FIG. 2, the observation axis 12 is angled away from the longitudinal axis of the missile 11 and its flight path 10, so that the system is capable of observing downwardly to detect a target 2 near the ground. On the other hand, when rotatable wedge element 5 is rotated to a position in which the two wedge elements 5, 6 are oppositely oriented, the observation axis 12 of the lens system 4 is shifted to align with the flight path 10 of the missile 11.

Output signals from the signal process unit 9 are provided to a control unit 13, which includes a central processing unit 14 and a plurality of motion sensors 15. The control unit 13 processes inputs from the signal processor 9 and the sensors 15 and performs guidance and control of the missile 11 as well as image stabilization as described hereinafter.

As shown in FIG. 2, during the search phase, stationary optical wedge element 6 and rotary optical wedge element 5 are position so that the optical image field is directed downward at a typical angle of 45°. By an appropriate selection of the detector matrix 8 (an InSb detector matrix with 256×256 individual detectors, for example) and the design of the lens system 4, at an altitude of 800 m a search strip (perpendicular to the flight direction) up to 1200 m wide is typically formed on the surface of the ground.

Figure 3:
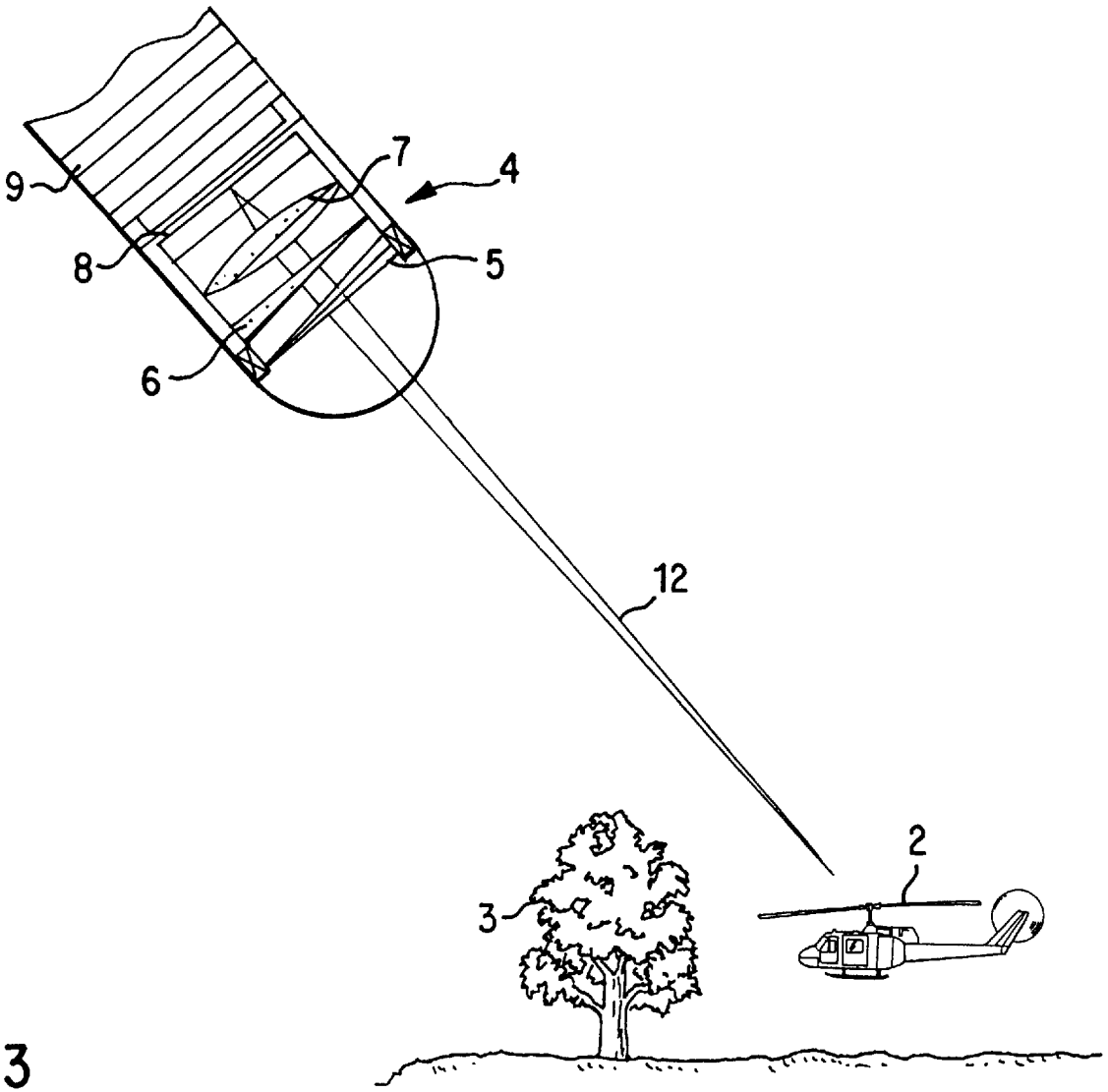
FIG. 3 is a schematic diagram of the target tracking phase according to the invention.

When a target 2 is detected because of its natural infrared radiation, modulated in an unambiguous fashion by the movements of the rotor blades, the missile, as shown in FIG. 3, approaches the target 2 in accordance with a conventional proportional navigation steering technique. At the same time, the rotatable wedge element 5 rotates 180° around the lengthwise axis of the missile so that the image field axis 12 is now oriented collinearly to the longitudinal axis of the missile. The missile then commences tracking the target 2 in a conventional manner.

After the search for the target and definite target recognition, the signal processing unit 9 determines the track, thereby improving the prediction of target movements and hit accuracy. In addition, measured values of position sensors 15 (roll, pitch, and yaw movements) are used in the signal evaluation system for image stabilization. The rotational and lengthwise movements of the missile 11 are quantitatively detected by sensors 15 and, by means of suitable algorithms, the visual field on the ground is stabilized electronically by the CPU 14 of the control unit 13, so that the frequency recognition of the helicopter can be performed within the scanning elements of a ground based laser coordinate system 16.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method for guiding a missile to impact an at least intermittently concealed target, said missile being of the type having an integrated target search head which identifies a target based on a characteristic modulation of a natural radiation pattern of said target within an image field of said target search head, said method comprising the steps of:

launching said missile on a flight path which is angled upward relative to a contour of surrounding terrain, and in a direction toward said target;

after said missile reaches a predetermined altitude, guiding said missile along a search flight path substantially parallel to the contour of said terrain, in the direction toward the target;

while said missile is guided along said search flight path, adjusting an image field axis of said target search head to a downward angle relative to said search flight path, toward said terrain;

detecting a target within said image field by means of signals from said target search head;

adjusting said image field axis of said target search head to coincide with a longitudinal axis of said missile; and tracking said target and guiding said missile to impact with said target by means signals from said target search head.

2. Method according to claim 1 wherein:

said target search head is an electro-optical device; and said steps of adjusting said image field axis of said target search head comprise adjusting a relative orientation of at least first and second optical elements which convey optical radiation received by said target search head.

3. Method according to claim 2 wherein:

said first and second optical elements are optical wedge elements, at least one of which is rotatable relative to the other; and said steps of adjusting said image field axis comprise rotating at least one of said wedge element relative to the other wedge element.

4. Method according to claim 1 further comprising the steps of:

sensing rotational and linear motion of said missile; and during said tracking and guiding step, stabilizing said image field relative to a ground based coordinate system, based on sensed motions of said missile.

5. Method according to claim 4 wherein:

said target is a helicopter; and said target search head detects said target based on modulation of natural radiation thereof by reason of rotor blade motion thereof.

6. Method according to claim 1 wherein said steps of adjusting said image field are performed by a mechanically defined and variable arrangement of mirrors.

7. Method according to claim 1 wherein an optimum impact area of the missile on the target is calculated from a time curve of the target movement (track formation) at the end of the target tracking phase.

8. Method according to claim 1 wherein the missile follows a flight path that runs approximately perpendicular to a direction in which the target was originally located.

9. Apparatus for guiding a missile to an at least intermittently concealed target, comprising:

a target search head integrated into said missile, said target search head having an image field within which it senses radiation from a target;

means for adjusting an axis of said image field to a downward angle toward a terrain contour during a search phase in which said missile follows a substantially horizontal flight path;

means for detecting said target based on radiation sensed by said search head within said image field;

means for adjusting said axis of said image field to coincide with a longitudinal axis of said missile during a tracking phase following detection of said target.

10. Apparatus according to claim 9 further comprising:

means for tracking said target and guiding said missile to impact with said target by means of signals from said target search head.

11. Apparatus according to claim 9 wherein:

said target search head is an electro-optical device and comprises first and second optical elements disposed in a path of optical radiation received by said target search head, which optical elements each modify a path of optical radiation incident thereon, orientation of said optical elements relative to each other being adjustable.

12. Apparatus according to claim 11 wherein said first and second optical elements are optical wedge elements disposed sequentially along a path of optical radiation received by said target search head, at least said first wedge element, being rotatable relative to said second wedge element about axis of said path of optical radiation.

* * * * *